US010527270B2

(12) United States Patent
Hiramatsu et al.

(10) Patent No.: US 10,527,270 B2
(45) Date of Patent: Jan. 7, 2020

(54) LIGHTING DRIVING DEVICE AND LIGHTING APPARATUS

(71) Applicant: PANASONIC INTELLECTUAL PROPERTY MANAGEMENT CO., LTD., Osaka (JP)

(72) Inventors: Kohji Hiramatsu, Osaka (JP); Tatsumi Setomoto, Osaka (JP); Tamotsu Ando, Osaka (JP); Tomokazu Yamamoto, Osaka (JP); Hajime Ozaki, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/887,459

(22) Filed: Feb. 2, 2018

(65) Prior Publication Data

US 2018/0238528 A1 Aug. 23, 2018

(30) Foreign Application Priority Data

Feb. 17, 2017 (JP) ..... 2017-028346

(51) Int. Cl.

| | |
|---|---|
| ***F21V 23/00*** | (2015.01) |
| ***F21S 8/02*** | (2006.01) |
| ***F21V 23/02*** | (2006.01) |
| ***F21V 21/04*** | (2006.01) |

(52) U.S. Cl.

CPC ..... *F21V 23/008* (2013.01); *F21S 8/026* (2013.01); *F21V 23/023* (2013.01); *F21V 21/047* (2013.01); *F21V 23/001* (2013.01)

(58) Field of Classification Search

CPC ..... F21S 8/026; F21V 21/047; F21V 23/001; F21V 23/023; F21V 23/0435; H05B 37/0272; H01Q 13/18

See application file for complete search history.

(56) References Cited

U.S. PATENT DOCUMENTS

| | | | | |
|---|---|---|---|---|
| 7,241,954 | B2 * | 7/2007 | Kanai | G03G 21/1619 174/377 |
| 9,967,928 | B2 * | 5/2018 | Harris | H05B 33/0842 |
| 10,405,406 | B2 * | 9/2019 | Liszt | F21K 9/235 |
| 2012/0268343 | A1 * | 10/2012 | Yanagi | H01Q 1/526 343/872 |
| 2016/0069551 | A1 | 3/2016 | Ando et al. | |
| 2016/0262245 | A1 | 9/2016 | Ando | |
| 2017/0374724 | A1 * | 12/2017 | Liszt | H05B 37/0272 |

FOREIGN PATENT DOCUMENTS

| | | | | |
|---|---|---|---|---|
| JP | 2012-174454 | * | 9/2012 | F21C 23/04 |
| JP | 2016-058167 | A | 4/2016 | |
| JP | 2016-162726 | A | 9/2016 | |

* cited by examiner

*Primary Examiner* — Peggy A Neils

(74) *Attorney, Agent, or Firm* — McDermott Will & Emery LLP

(57) ABSTRACT

A lighting driving device is to be installed on a part of a structure. The lighting driving device includes: a metallic casing including a slit through which radio waves pass; a communication circuit which is housed in the metallic casing and performs wireless communication; a driving circuit which is housed in the metallic casing and supplies power to a light emitter; and an insulator which is disposed on the metallic casing and spaces apart the slit from the part of the structure.

15 Claims, 6 Drawing Sheets

LIGHTING DRIVING DEVICE AND LIGHTING APPARATUS

CROSS REFERENCE TO RELATED APPLICATION

This application claims the benefit of priority of Japanese Patent Application Number 2017-028346 filed on Feb. 17, 2017, the entire content of which is hereby incorporated by reference.

BACKGROUND

1. Technical Field

The present disclosure relates to a lighting driving device and a lighting apparatus including the lighting driving device.

2. Description of the Related Art

Conventionally, a lighting apparatus which includes a power supply circuit for supplying power to a light source, an antenna for transmitting or receiving a radio signal, and a metallic casing for housing the power supply circuit and the antenna is disclosed (see, for example, Japanese Unexamined Patent Application Publication No. 2016-58167). The metallic casing has an opening formed therein. The antenna is disposed so as to emit radio waves through the opening.

With such a lighting apparatus, it is possible to secure a communication function of wireless communication, and improve a communication quality.

SUMMARY

However, when the lighting apparatus is installed on a part of a structure such as a ceiling, a wall, etc., there are instances where a lighting driving device which includes a driving circuit, a metallic casing, etc. is disposed on a part of a structure such as a metallic beam, due to a restriction on a position at which the lighting driving device is disposed. In this case, even when a slit is formed in the metallic casing, the slit might be covered by the metallic beam, depending on the position at which the lighting driving device is disposed.

In view of the above, an object of the present disclosure is to provide a lighting driving device and a lighting apparatus which can secure a communication function and a communication quality of a communication circuit, even when the lighting driving device is mounted to a conductor.

In order to achieve the above-described object, a lighting driving device according to an aspect of the present disclosure is a lighting driving device to be installed on a part of a structure, and includes: a metallic casing including a slit through which radio waves pass; a communication circuit which is housed in the metallic casing and performs wireless communication; a driving circuit which is housed in the metallic casing and supplies power to a light emitter; and an insulator which is disposed on the metallic casing and spaces apart the slit from the part of the structure.

In addition, in order to achieve the above-described object, a lighting apparatus according to an aspect of the present disclosure includes the light emitter, and a lighting driving device which supplies power to the light emitter.

According to the present disclosure, it is possible to secure a communication function and a communication quality of a communication circuit, even when the lighting driving device is mounted to a conductor.

BRIEF DESCRIPTION OF DRAWINGS

The figures depict one or more implementations in accordance with the present teaching, by way of examples only, not by way of limitations. In the figures, like reference numerals refer to the same or similar elements.

Figure 2:
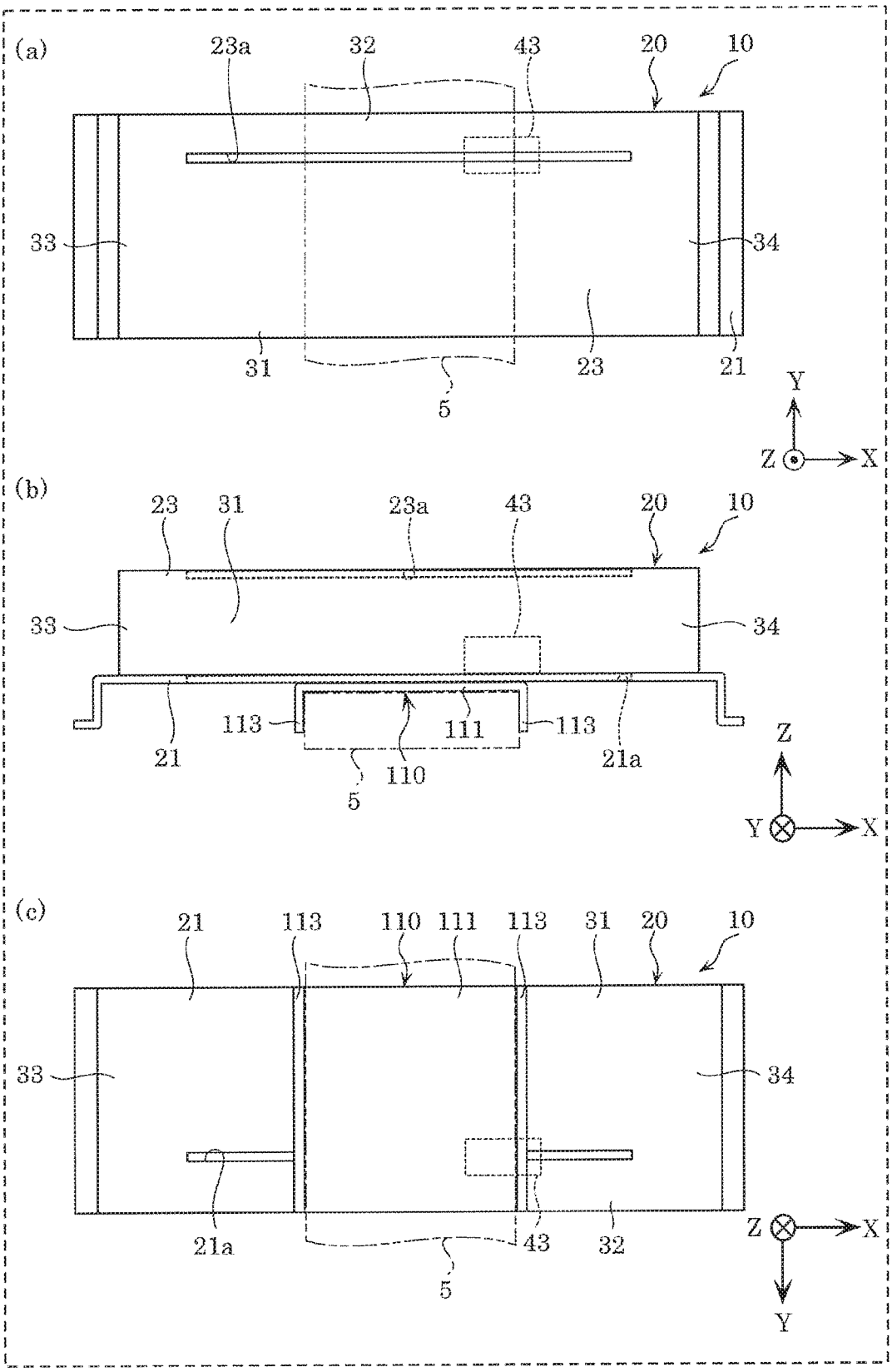
Figure 3:
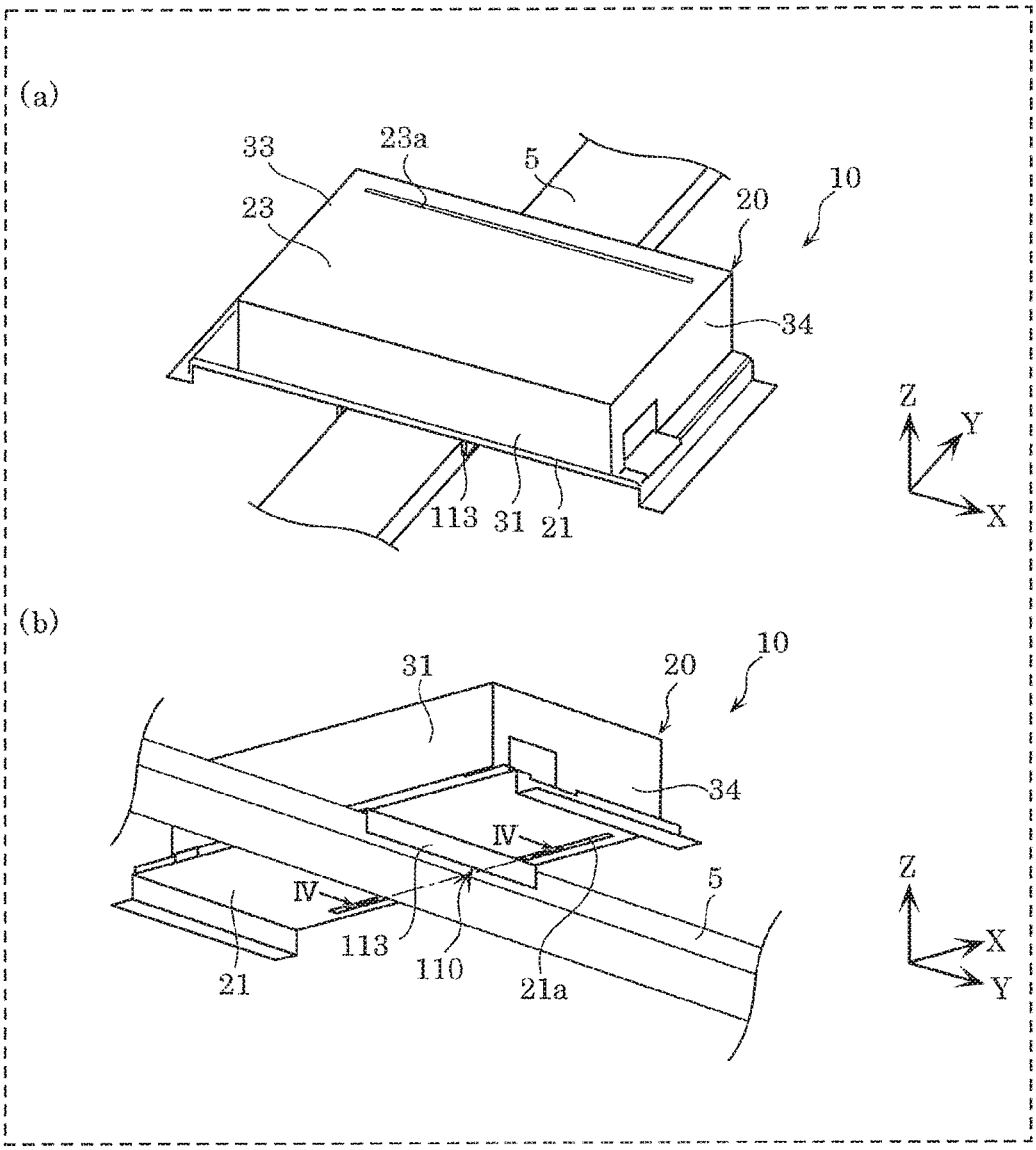
Figure 4:
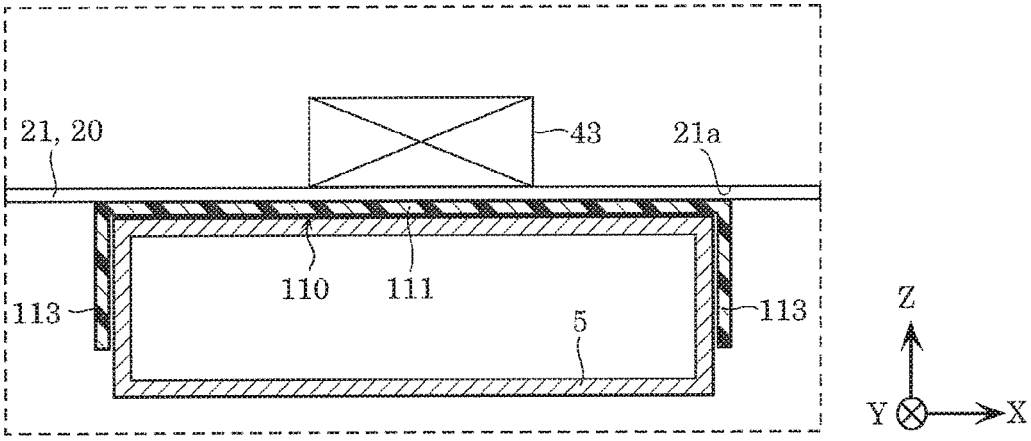
Figure 5:
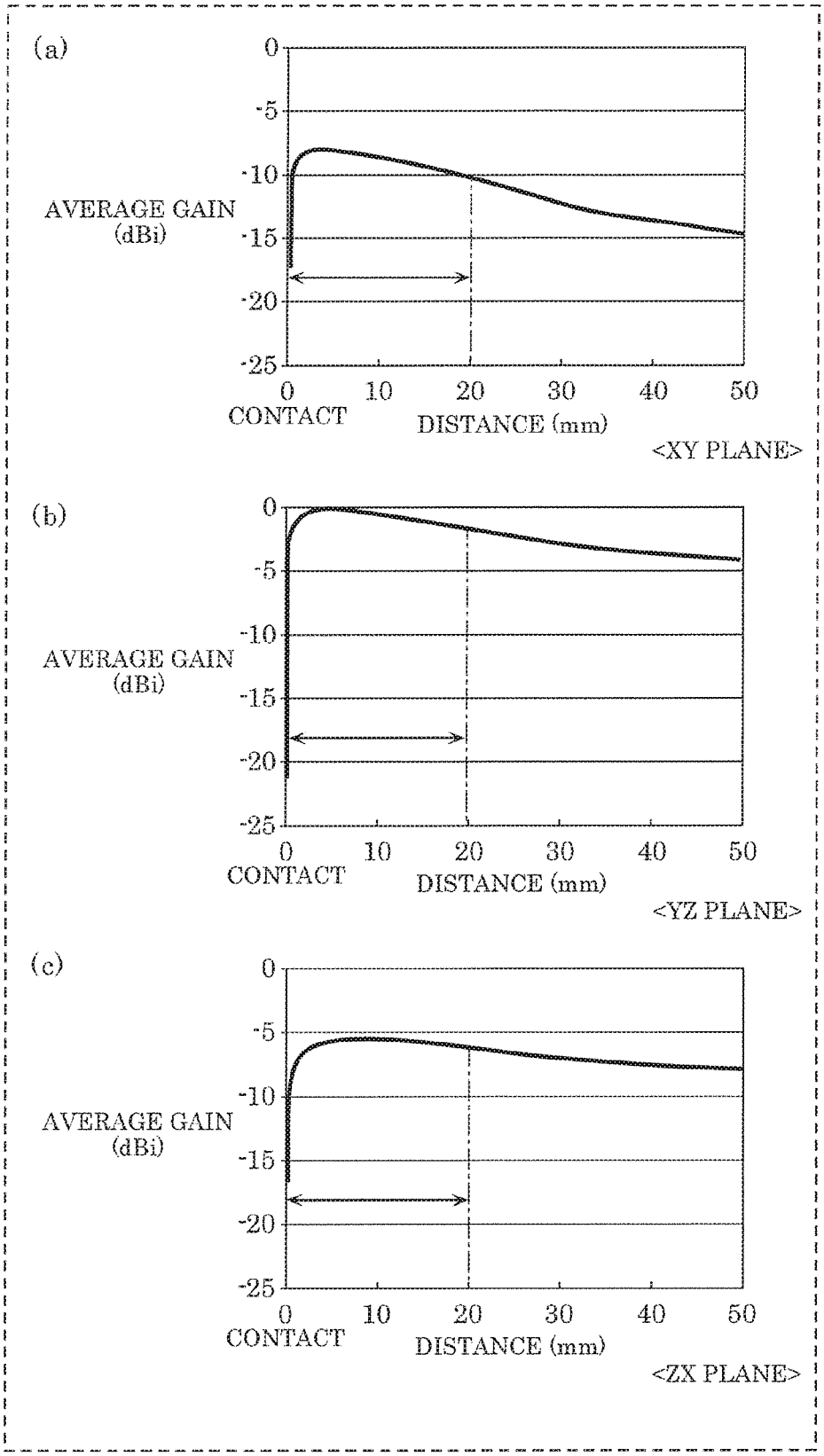
Figure 6:
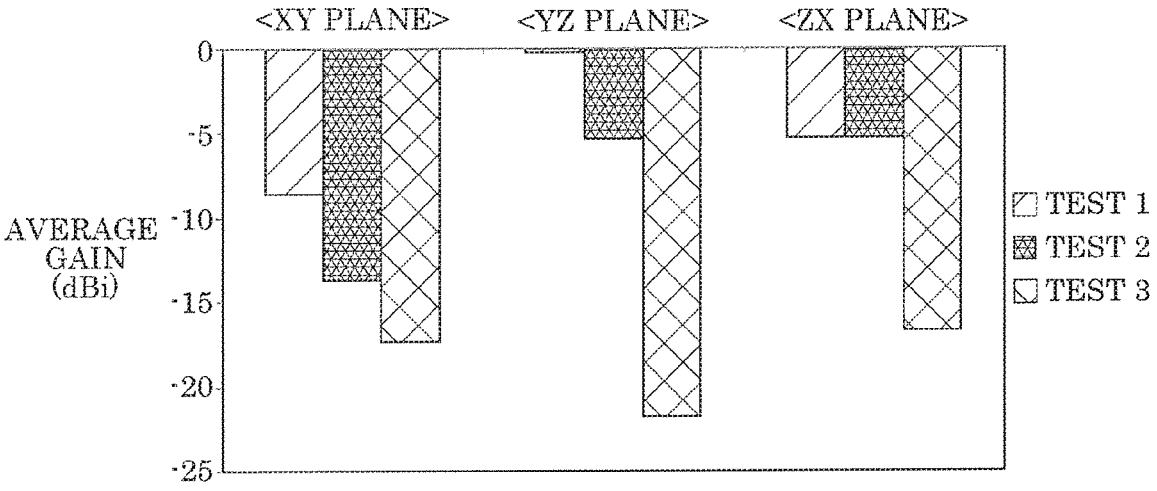
Figure 7:
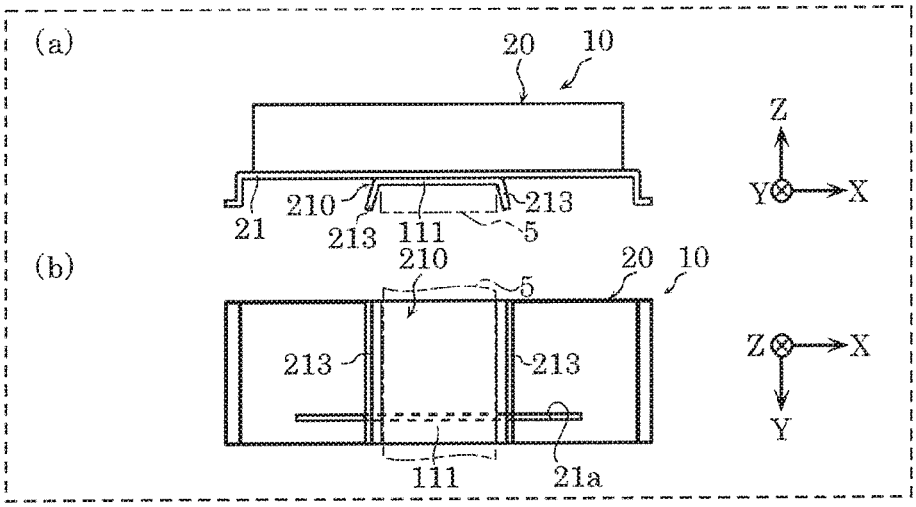
Figure 8:
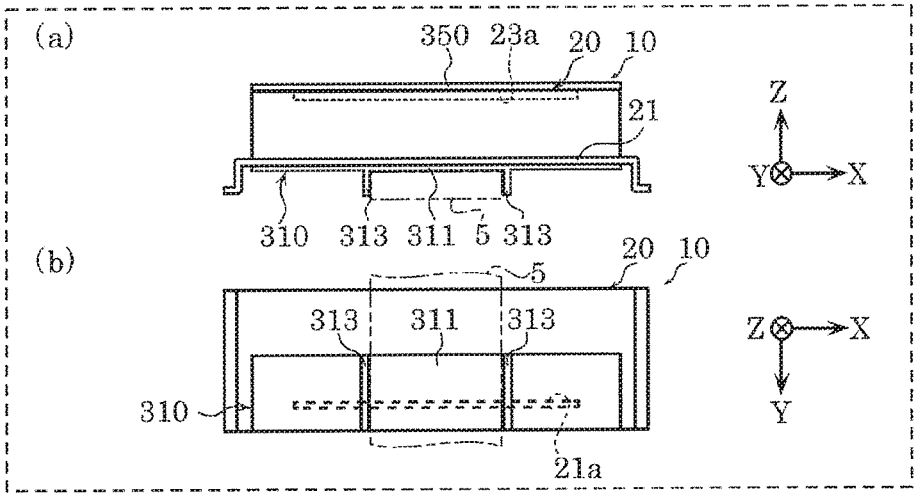
Figure 9:
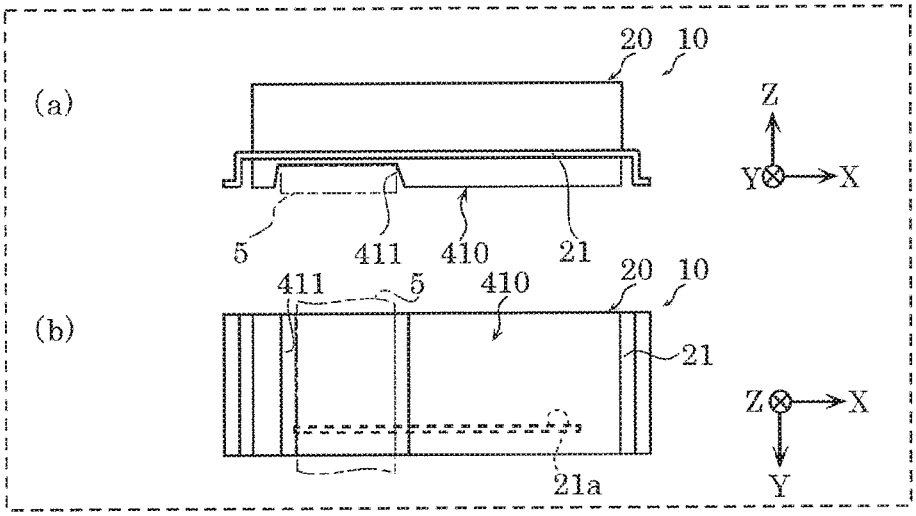

(a) in FIG. 2 is a plan view which illustrates the lighting driving device according to the embodiment; (b) in FIG. 2 is a side view which illustrates the lighting driving device according to the embodiment; (c) in FIG. 2 is a rear view which illustrates the lighting driving device according to the embodiment;

(a) in FIG. 3 is a perspective view of the lighting driving device, a guide, and a conductor according to the embodiment, which are viewed from a Z-axis plus side; (b) in FIG. 3 is a perspective view of the lighting driving device and the guide according to the embodiment, which are viewed from a Z-axis minus side;

FIG. 4 is a partially enlarged cross-sectional view which illustrates the lighting driving device and the guide according to the embodiment, along the line IV-IV of (b) in FIG. 3;

(a) in FIG. 5 is a graph which indicates a relationship between an average gain and a distance from a slit to the conductor, when directivity characteristics of radio waves emitted through the slit are calculated on an XY plane defined by the X-axis direction and the Y-axis direction; (b) in FIG. 5 is a graph which indicates a relationship between an average gain and a distance from the slit to the conductor, when directivity characteristics of radio waves emitted through the slit are calculated on an YZ plane defined by the Y-axis direction and the Z-axis direction; (c) in FIG. 5 is a graph which indicates a relationship between an average gain and a distance from the slit to the conductor, when directivity characteristics of radio waves emitted through the slit are calculated on an ZX plane defined by the Z-axis direction and the X-axis direction;

FIG. 6 is a graph which indicates an average gain of each of the XY plane, the YZ plane, and the ZX plane;

(a) in FIG. 7 is a side view which illustrates a lighting driving device and a guide according to Variation 1 of the embodiment; (b) in FIG. 7 is a rear view which illustrates the lighting driving device and the guide according to Variation 1 of the embodiment;

(a) in FIG. 8 is a side view which illustrates a lighting driving device and a guide according to Variation 2 of the embodiment; (b) in FIG. 8 is a rear view which illustrates the lighting driving device and the guide according to Variation 2 of the embodiment;

(a) in FIG. 9 is a side view which illustrates a lighting driving device and a guide according to Variation 3 of the embodiment; and (b) in FIG. 9 is a rear view which illustrates the lighting driving device and the guide according to Variation 3 of the embodiment.

DETAILED DESCRIPTION OF THE EMBODIMENTS

Hereinafter, an embodiment of the present invention will be described with reference to the drawings. It should be noted that the subsequently-described embodiment shows a specific example of the present disclosure. Therefore, numerical values, shapes, materials, structural components, the arrangement and connection of the structural components, etc. shown in the following exemplary embodiment are mere examples, and are not intended to limit the scope of the present invention. Furthermore, among the structural components in the following exemplary embodiment, components not recited in the independent claim which indicates the broadest concept of the present invention are described as arbitrary structural components.

Moreover, "substantially" and "approximately" mean, for example in the case of "substantially the same", not only exactly the same, but what would be recognized as essentially the same as well.

In addition, each of the diagrams is a schematic diagram and thus is not necessarily strictly illustrated. In each of the diagrams, substantially the same structural components are assigned with the same reference signs, and redundant descriptions will be omitted or simplified.

The following describes a lighting driving device and a lighting apparatus according to an embodiment of the present disclosure.

Embodiment (Configuration)

First, a configuration of lighting driving device 10 and lighting apparatus 1 according to the embodiment shall be described with reference to FIG. 1 to FIG. 4.

Figure 1:
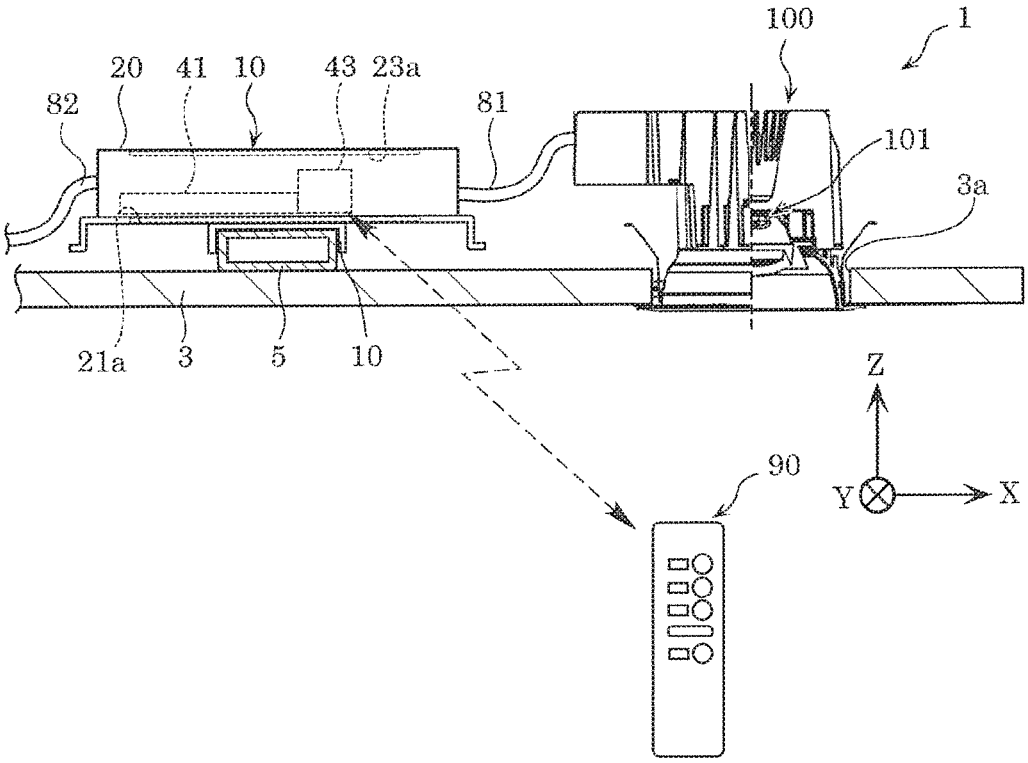
FIG. 1 is a diagram which illustrates a lighting apparatus according to the embodiment.

FIG. 1 is a cross-sectional view which illustrates a portion of lighting apparatus 1 according to the embodiment. In FIG. 2, (a) is a plan view of lighting driving device 10 according to the embodiment. In FIG. 2, (b) is a side view of lighting driving device 10 according to the embodiment. In FIG. 2, (c) is a rear view of lighting driving device 10 according to the embodiment. In FIG. 2, conductor 5 is illustrated by a two-dot chain line. In FIG. 3, (a) is a perspective view of lighting driving device 10, guide 110, and conductor 5 according to the embodiment, which are viewed from a Z-axis plus side. In FIG. 3, (b) is a perspective view of lighting driving device 10 and guide 110 according to the embodiment, which are viewed from a Z-axis minus side. FIG. 4 is a partially enlarged cross-sectional view which illustrates a side face of lighting driving device 10 and guide 110 according to the embodiment, along the line IV-IV of (b) in FIG. 3.

Directions of X, Y, and Z are defined as follows: the longitudinal direction of slit 21*a* is defined as an X-axis direction; the longitudinal direction of conductor 5 is defined as a Y-axis direction; and the direction which is orthogonal to the X-axis direction and the Y-axis direction is defined as a Z-axis direction. With respect to lighting driving device 10, the side where device body 100 is located is defined as an X-axis plus side. In a plan view of metallic casing 20, the side where slit 21*a* is located is defined as a Y-axis plus side. The side above conductor 5, where lighting driving device 10 is located, is defined as the Z-axis plus side. It should be noted that the directions illustrated in FIG. 1 correspond to the directions illustrated in FIG. 2. The same applies to all subsequent figures.

As illustrated in FIG. 1, lighting apparatus 1 is, for example, a downlight or the like. FIG. 1 illustrates a state in which lighting apparatus 1 is mounted in recessed hole 3*a* formed in ceiling 3. Lighting apparatus 1 according to the embodiment is, for example, recessed lighting apparatus 1 which is installed by being recessed in ceiling 3 of a house or the like, to emit light onto a floor, a wall, etc. It should be noted that lighting apparatus 1 may be a linear-tube LED lamp.

Lighting apparatus 1 includes lighting driving device 10 and device body 100.

Lighting driving device 10 is installed in a ceiling or the like, for example. Lighting driving device 10 is connected, via power line 82, to a system power (commercial power supply) that is a source of supplying AC power. Lighting driving device 10 is electrically connected to device body 100 via interconnecting line 81, and supplies power to device body 100. Lighting driving device 10 is elongated in the X-axis direction. Here, the part of a structure used in installing lighting driving device 10 is conductor 5 which includes metal and has an elongate shape, such as a beam made of a metal material, for example. However, the part of a structure may be a ceiling, a wall, or the like.

Lighting driving device 10 includes metallic casing 20, guide 110, driving circuit 41, and communication circuit 43.

Metallic casing 20 is a metallic box which houses driving circuit 41, communication circuit 43, etc. therein. Metallic casing 20 has an elongate shape in the X-axis direction. Metallic casing 20 is shaped by, for example, bending a plate component made of metal such as aluminum.

As illustrated in (a) to (c) of FIG. 2, metallic casing 20 has a plurality of faces each of which has a substantially rectangular shape. More specifically, metallic casing 20 includes bottom portion 21, ceiling portion 23, first side wall portion 31, second side wall portion 32, third side wall portion 33, and fourth side wall portion 34.

Bottom portion 21 is a bottom wall of metallic casing 20, and is disposed on the Z-axis minus side of metallic casing 20. Bottom portion 21 is substantially parallel to a plane defined by the X-axis direction and the Y-axis direction. Ceiling portion 23 is disposed to face bottom portion 21. Ceiling portion 23 is a wall (ceiling) of metallic casing 20, and disposed on the Z-axis plus side of metallic casing 20. Ceiling portion 23 is substantially parallel to bottom portion 21. First side wall portion 31 is a side wall disposed on an end of bottom portion 21 and ceiling portion 23 on the Y-axis minus side. First side wall portion 31 is substantially parallel to a plane defined by the X-axis direction and the Z-axis direction. Second side wall portion 32 is a side wall disposed to face first side wall portion 31 on an end of bottom portion 21 and ceiling portion 23 on the Y-axis plus side. Second side wall portion 32 is substantially parallel to first side wall portion 31. Third side wall portion 33 is a side wall disposed on an end of bottom portion 21 and ceiling portion 23 on the X-axis minus side. Third side wall portion 33 is substantially parallel to a plane defined by the Y-axis direction and the Z-axis direction. Fourth side wall portion 34 is a side wall disposed to face first side wall portion 31 on an end of bottom portion 21 and ceiling portion 23 on the X-axis plus side. Fourth side wall portion 34 is substantially parallel to third side wall portion 33. In other words, first side wall portion 31, second side wall portion 32, third side wall portion 33, and fourth side wall portion 34 surround a periphery of bottom portion 21 and ceiling portion 23.

It should be noted that metallic casing 20 may be configured by combining a first cover and a second cover. For example, the first cover may be disposed on the Z-axis minus side of metallic casing 20, and the second cover may be disposed on the Z-axis plus side of metallic casing 20. In this case, for example, the first cover may include bottom portion 21, first side wall portion 31, and second side wall portion 32, and the second cover may include ceiling portion 23, third side wall portion 33, and fourth side wall portion 34.

As illustrated in (c) of FIG. 2, slit 21*a* which penetrates in the Z-axis direction through bottom portion 21 is formed in bottom portion 21. Slit 21*a* is a cutout for causing radio waves to pass through. According to the present embodiment, slit 21*a* is a cutout that is elongated in the X-axis direction. Slit 21*a* may have a length that is at least an approximately half of a wavelength that corresponds to a frequency of a radio signal. For example, when lighting driving device 10 is mounted above conductor 5 (also referred to as a channel) such as a metallic beam, the longitudinal direction of slit 21*a* and conductor 5 are three-dimensionally crossed with each other. In particular, in the case where lighting driving device 10 is mounted above conductor 5 such as a metallic beam, slit 21*a* may be substantially orthogonal to conductor 5 when slit 21*a* and conductor 5 are viewed in the Z-axis direction.

Bottom portion 21 is provided with an insulator for spacing apart conductor 5 from slit 21*a*. More specifically, the insulator is mounted on a portion of metallic casing 20 in which slit 21*a* is formed. The insulator is guide 110 for mounting metallic casing 20 to conductor 5.

Guide 110 is a component which guides (mounts) lighting driving device 10 to conductor 5 when installing lighting driving device 10 to conductor 5, in such a manner that the longitudinal direction of lighting driving device 10 (the longitudinal direction of slit 21*a*) and the longitudinal direction of conductor 5 are three-dimensionally crossed with each other. Guide 110 is made of an insulating material including a resin or the like.

Guide 110 is mounted on a surface of bottom portion 21 on the Z-axis minus side so as to cover a portion of slit 21*a*. According to the present embodiment, guide 110 is fixed to bottom portion 21 so as to cover a center portion of slit 21*a*. In other words, as illustrated in (c) of FIG. 2 and (a) of FIG. 3, guide 110 guides conductor 5 such that conductor 5 overlaps with the center portion of slit 21*a* in a plan view of slit 21*a* and conductor 5.

Guide 110 is detachable from metallic casing 20. Guide 110 is, for example, fixed to metallic casing 20 by a component such as a screw, a tape, etc.

As illustrated in (a) to (c) of FIG. 2, (a) of FIG. 3, and (b) of FIG. 3, guide 110 includes flat plate portion 111 and a pair of lateral wall portions 113.

As illustrated in (c) of FIG. 2 and (b) of FIG. 3, flat plate portion 111 is a rectangular flat plate, and is in surface-to-surface contact with a surface of bottom portion 21 on the Z-axis minus side so as to cover a portion of slit 21*a*.

Lateral wall portions 113 restrict a movement of metallic casing 20. More specifically, as illustrated in FIG. 4, when lighting driving device 10 is mounted to conductor 5 by causing guide 110 to be engaged with conductor 5, the pair of lateral wall portions 113 hold conductor 5 from the both sides of conductor 5. In other words, the pair of lateral wall portions 113 are in contact with conductor 5 at the time of mounting lighting driving device 10 to conductor 5, and thus a movement of lighting driving device 10 in the X-axis directions is restricted.

More specifically, one of the pair of lateral wall portions 113 is a side wall disposed at an end of flat plate portion 111 on the X-axis plus side, and is substantially parallel to a plane defined by the Z-axis direction and the Y-axis direction. The other of the pair of lateral wall portions 113 is a side wall disposed to face the one of the pair of lateral wall portions 113, at an end of flat plate portion 111 on the X-axis minus side, and is substantially parallel to the plane defined by the Z-axis direction and the Y-axis direction.

It should be noted that the total number of lateral wall portions 113 may be one or may be three or more, and it is not necessary for conductor 5 to be held by lateral wall portions 113 from the both sides of conductor 5, for example.

As illustrated in (a) of FIG. 2 and (a) of FIG. 3, slit 23*a* which penetrates in the Z-axis direction through ceiling portion 23 is formed in ceiling portion 23. Slit 23*a* is a cutout that is elongated in the X-axis direction, according to the present embodiment. Slit 23*a* may have a length that is at least an approximately half of wavelength that corresponds to a frequency of a radio signal. For example, when lighting driving device 10 is mounted above conductor 5 which is a metallic beam or the like, the longitudinal direction of slit 23*a* is three-dimensionally crossed with conductor 5. In particular, when lighting driving device 10 is installed on conductor 5 such as a metallic beam, metallic casing 20 may be mounted such that slit 23*a* is substantially orthogonal to conductor 5. In other words, in a plan view of conductor 5 and slit 21*a*, guide 110 mounts metallic casing 20 such that conductor 5 and slit 23*a* are substantially orthogonal to each other.

It should be noted that metallic casing 20 may be provided with three or more slits including slits 21*a* and 23*a*, or may be provided with only slit 21*a*. In addition, the shapes of slits 21*a* and 23*a* are not specifically limited.

As illustrated in FIG. 1, driving circuit 41 is a circuit (lighting-up circuit) for supplying power to light emitter 101 of device body 100. More specifically, driving circuit 41 converts AC power supplied from system power or the like via interconnecting line 81, into DC power, and supplies the DC power to light emitter 101.

Driving circuit 41 is, for example, formed using a printed circuit board. More specifically, driving circuit 41 includes a diode bridge rectifier circuit which converts AC power to DC power, and a DC-DC converter. It should be noted that driving circuit 41 may be implemented by a single integrated circuit (IC) which has a function equivalent to the functions of the rectifier circuit and the DC-DC converter.

As illustrated in (a) to (c) in FIG. 2, communication circuit 43 is a communication module which includes an antenna for performing wireless communication with an external device (e.g., remote control 90 illustrated in FIG. 1). Communication circuit 43 is electrically connected to driving circuit 41. Communication circuit 43 is disposed in proximity to slit 21*a*.

As illustrated in FIG. 1, communication circuit 43 includes an antenna and a radio control circuit.

The antenna is a conductive pattern disposed on a printed circuit board. The antenna is a pattern antenna for transmitting or receiving a radio signal. It should be noted that the antenna is not limited to the pattern antenna, and may be any antenna as long as the antenna performs at least one of transmitting a radio signal and receiving a radio signal.

The frequency band of a radio signal which the antenna transmits or receives is, for example, an ultra high frequency (UHF) band or a super high frequency (SHF) band.

The radio control circuit is an integrated circuit which controls transmitting or receiving of a radio signal performed by the antenna. According to the present embodiment, the radio control circuit obtains a predetermined command included in a radio signal received by the antenna from remote controller 90. The radio control circuit controls a power supply circuit according to the obtained command.

More specifically, the radio control circuit turning on and off a light source, by controlling the power supply circuit.

Device body 100 is a device which is supplied with power from lighting driving device 10 via interconnecting line 81, to perform lighting. Device body 100 is a casing shaped into a substantially circular truncated cone. Device body 100 includes light emitter 101, a plurality of cooling fins, and an attaching spring.

Light emitter 101 is a device which is supplied with power to emit light. Light emitter 101 includes a substrate on which a light source is mounted, and emits predetermined light. According to the present embodiment, the light source is, for example, a packaged white LED element of a surface mount device (SMD) type. A chip on board (COB) LED element in which an LED chip is directly mounted on the substrate is used.

The cooling fins are disposed on an outer peripheral surface of device body 100, and protrude outwardly. The cooling fins are metallic fins for releasing, to the outside, heat generated when the light source emits light. The cooling fins are, for example, integrally formed with device body 100.

The attaching spring is mounted on the outer peripheral surface of device body 100. The attaching spring is outwardly biased on the outer peripheral surface of device body 100. The attaching spring is used for attaching device body 100 into recessed hole 3*a*.

(Result of Analysis)

The inventors of the present disclosure conducted a simulation analysis regarding an average gain of communication circuit 43 when lighting driving device 10 is mounted to conductor 5 via guide 110.

Conditions of the simulation analysis are as follows: the frequency of wireless communication is 920 MHz; the width of slit 21*a* is 2 mm; and the length of slit 21*a* is 145 mm. In addition, lighting driving device 10 is mounted to conductor 5 such that slit 21*a* and conductor 5 are orthogonal to each other.

First, a relationship between an average gain and a distance from slit 21*a* to conductor 5 will be described.

In FIG. 5, (a) is a graph which indicates a relationship between an average gain and a distance from slit 21*a* to conductor 5, when directivity characteristics of radio waves emitted through slit 21*a* are calculated on an XY plane defined by the X-axis direction and the Y-axis direction. In FIG. 5, (b) is a graph which indicates a relationship between an average gain and a distance from slit 21*a* to conductor 5, when directivity characteristics of radio waves emitted through slit 21*a* are calculated on an YZ plane defined by the Y-axis direction and the Z-axis direction. In FIG. 5, (c) is a graph which indicates a relationship between an average gain and a distance from slit 21*a* to conductor 5, when directivity characteristics of radio waves emitted through slit 21*a* are calculated on an ZX plane defined by the Z-axis direction and the X-axis direction.

In FIG. 5, when conductor 5 and bottom portion 21 are in contact with each other (i.e., when the distance between slit 21*a* and conductor 5 is 0 mm), the average gain decreases in any of the graphs. It is indicated that the average gain increases when conductor 5 and bottom portion 21 are spaced apart by even a little. The result shows that there is a peak of the average gain when the distance between slit 21*a* and conductor 5 is approximately in a range from 0 mm to 20 mm. In view of this, guide 110 causes the distance between conductor 5 and slit 21*a* to be in a range from greater than 0 mm to 20 mm or less. For example, the average gain can be improved by setting the thickness of flat-plate portion 111 of guide 110 to be in a range greater than 0 mm and to approximately 20 mm.

Next, a result of a simulation analysis regarding an average gain will be described.

FIG. 6 is a graph which indicates an average gain of each of the XY plane, the YZ plane, and the ZX plane.

As illustrated in FIG. 6, TEST 1 indicates the case where the distance between slit 21*a* and conductor 5 is 0.8 mm, TEST 2 indicates the case where there is no conductor 5 (i.e., the distance between slit 21*a* and conductor 5 is infinite), and TEST 3 indicates the case where the distance between slit 21*a* and conductor 5 is 0 mm (i.e., slit 21*a* and conductor 5 are in contact with each other). It should be noted that lighting driving device 10 according to the present embodiment is used in TEST 1 to TEST 3.

In TEST 3, the average gain is −15 (dBi) or less in any of the planes (the XY plane, the YZ plane, and the ZX plane). In TEST 2, although the average gain is not deteriorated as much as the case in TEST 3, the average gain is not improved as much as the case in TEST 1 in the XY plane and the YZ plane. The result of TEST 1 indicates that the average gain improves in any of the planes. In addition, in the YZ plane of TEST 1, the average gain improves by approximately 22 dBi compared to the case of TEST 3. In particular, when conductor 5 is slightly spaced apart from slit 21*a* in the XY plane and the YZ plane, the average gain improved by approximately 5.1 dBi and approximately 5 dBi, compared to the case where conductor 5 is not provided.

(Advantageous Effect)

Next, an advantageous effect of lighting driving device 10 and lighting apparatus 1 according to the present embodiment will be described.

As described above, lighting driving device 10 according to the present embodiment is to be installed on a part of a structure (conductor 5). In addition, lighting driving device 10 includes: metallic casing 20 including slit 21*a* through which radio waves pass; communication circuit 43 which is housed in metallic casing 20 and performs wireless communication; driving circuit 41 which is housed in metallic casing 20 and supplies power to light emitter 101; and an insulator (guide 110) which is disposed on metallic casing 20 and spaces apart slit 21*a* from the part of the structure (conductor 5).

In this manner, since guide 110 which spaces apart metallic casing 20 from conductor 5 is provided to metallic casing 20, slit 21*a* is not covered by conductor 5. For that reason, even when lighting driving device 10 is disposed on conductor 5 due to a restriction on a position at which lighting driving device 10 is mounted at the time of installing lighting apparatus 1, it is possible to improve a communication performance of communication circuit 43.

Accordingly, it is possible to secure a communication function and a communication quality of communication circuit 43, even when lighting driving device 10 is disposed on conductor 5.

In addition, lighting apparatus 1 according to the present embodiment includes light emitter 101, and lighting driving device 10 which supplies power to light emitter 101.

Lighting apparatus 1 in which such lighting driving device 10 as described above is used also produces advantageous effects the same as or similar to the above-described advantageous effects.

In addition, in lighting driving device 10 according to the present embodiment, the part of the structure is conductor 5. In addition, the insulator is guide 110 for mounting metallic casing 20 to conductor 5. Guide 110 mounts metallic casing 20 to conductor 5 such that conductor 5 and slit 21*a* are three-dimensionally crossed with each other.

In this manner, since guide 110 mounts metallic casing 20 to conductor 5 such that conductor 5 and slit 21*a* are three-dimensionally crossed with each other, it is possible for communication circuit 43 to secure a radio wave intensity and expand a communication distance.

In addition, in lighting driving device 10 according to the present embodiment, conductor 5 has an elongate shape, and guide 110 mounts metallic casing 20 to conductor 5 such that conductor 5 and slit 21*a* are substantially orthogonal to each other in a plan view of conductor 5 and slit 21*a*.

In this manner, since guide 110 mounts metallic casing 20 to conductor 5 such that slit 21*a* is substantially orthogonal to conductor 5, it is possible for communication circuit 43 to more reliably secure a radio wave intensity and expand a communication distance.

In addition, in lighting driving device 10 according to the present embodiment, guide 110 has lateral wall portion 113 which restricts a movement of metallic casing 20.

In this manner, since lateral wall portion 113 restricts a movement of metallic casing 20, it is possible to make lighting driving device 10 stably disposed on conductor 5.

In addition, in lighting driving device 10 according to the present embodiment, lateral wall portion 113 of guide 110 includes a pair of lateral wall portions 113, and the pair of lateral wall portions 113 hold conductor 5 therebetween when mounting lighting driving device 10 to conductor 5.

In this manner, since lateral wall portions 113 hold conductor 5 therebetween, it is possible to make lighting driving device 10 stably disposed more solidly on conductor 5.

In addition, in lighting driving device 10 according to the present embodiment, a distance between conductor 5 and slit 21*a* is less than or equal to 20 mm.

According to this configuration, since it is possible to improve an average gain, it is possible to secure a communication function and a communication quality of communication circuit 43.

In addition, in lighting driving device 10 according to the present embodiment, the insulator (guide 110) is detachable from metallic casing 20.

According to this configuration, by attaching guide 110 to metallic casing 20 at the time of installing lighting apparatus 1 on conductor 5, it is possible to easily secure a communication function and a communication quality of communication circuit 43 of lighting driving device 10.

In addition, in lighting driving device 10 according to the present embodiment, when metallic casing 20 is mounted to conductor 5 with guide 110 being interposed therebetween, guide 110 covers a portion of slit 21*a*.

In addition, in lighting driving device 10 according to the present embodiment, slit 21*a* has a length that is at least a half of a wavelength of a radio signal passing through slit 21*a* when communication circuit 43 performs wireless communication.

In addition, in lighting driving device 10 according to the present embodiment, communication circuit 43 is disposed in proximity to slit 21*a*.

In addition, lighting driving device 10 according to the present embodiment is to be installed on conductor 5. Lighting driving device 10 includes: metallic casing 20 including slit 21*a* through which radio waves pass; communication circuit 43 which is housed in metallic casing 20 and performs wireless communication with an external device that transmits a radio signal for controlling light emitter 101; driving circuit 41 which is housed in metallic casing 20, and supplies power to light emitter 101 according to the control signal received by communication circuit 43; and guide 110 which is disposed on metallic casing 20 and spaces apart slit 21*a* from conductor 5.

Variation 1 of the Embodiment

The following describes lighting driving device 10 according to Variation 1 of the embodiment.

In FIG. 7, (a) is a side view which illustrates lighting driving device 10 and guide 210 according to Variation 1 of the embodiment. In FIG. 7, (b) is a rear view which illustrates lighting driving device 10 and guide 210 according to Variation 1 of the embodiment.

The present variation is different from the embodiment in the shape of lateral wall portions 213 of guide 210.

Lighting driving device 10 of the present variation is similar to or same as lighting driving device 10 of the embodiment in other structural components, and thus the same structural components are assigned with the same reference signs, and detailed descriptions for the structural components will be omitted.

As illustrated in (a) and (b) of FIG. 7, lateral wall portions 213 of guide 210 are disposed on the both sides of conductor 5 so as to be opposed to each other with conductor 5 being interposed therebetween. The distance between the pair of lateral wall portions 213 increases in the direction in which the pair of lateral wall portions 213 rise from a bottom member. In other words, the distance from one of the pair of lateral wall portions 213 to the other gradually increases in the Z-axis minus direction so that it is possible to easily guide conductor 5 into guide 210 at the time of mounting lighting driving device 10 to conductor 5. Although the bottom member is flat-plate portion 111 according to the present embodiment, the bottom member is not limited to flat-plate portion 111, and the bottom member may be bottom portion 21.

In lighting driving device 10 according to the present variation, guide 210 includes the pair of lateral wall portions 213. The distance between the pair of lateral wall portions 213 increases in the direction in which the pair of lateral wall portions 213 rise.

In this manner, since the distance between the pair of lateral wall portions 213 increases in the direction in which the pair of lateral wall portions 213 rise, it is possible to easily guide conductor 5 into guide 210 at the time of mounting lighting driving device 10 to conductor 5.

The present variation produces other advantageous effects in the same manner as the embodiment.

Variation 2 of the Embodiment

The following describes lighting driving device 10 according to Variation 2 of the embodiment.

In FIG. 8, (a) is a side view which illustrates lighting driving device 10 and guide 310 according to Variation 2 of the embodiment. In FIG. 8, (b) is a rear view which illustrates lighting driving device 10 and guide 310 according to Variation 2 of the embodiment.

The present variation differs from the embodiment in that slits 21*a* and 23*a* are entirely covered by guide 310.

Lighting driving device 10 of the present variation is similar to or same as lighting driving device 10 of the embodiment in other structural components, and thus the same structural components are assigned with the same reference signs, and detailed descriptions for the structural components will be omitted.

As illustrated in (a) and (b) of FIG. 8, guide 310 fixed to bottom portion 21 of metallic casing 20 covers the entirety of slit 21*a* in bottom portion 21. Two lateral wall portions 313 of guide 310 are disposed around the center of flat-plate portion 311 so as to allow the two lateral wall portions 313 to hold conductor 5 therebetween.

In addition, cover 350 (an example of an insulator) which covers the entirety of slit 23*a* is provided on ceiling portion 23. It should be noted that, although guide 310 and cover 350 are different component in this case, guide 310 and cover 350 may be integrally formed.

In lighting driving device 10 according to present variation as described above, a plurality of slits including slits 21*a* and 23*a* are formed in metallic casing 20. Metallic casing 20 has one or more portions each of which includes at least one of the plurality of slits including slits 21*a* and 23*a* and on each of which an insulator (guide 110) is mounted.

In this manner, since guide 310 and cover 350 are disposed on the plurality of slits 21*a* and 23*a* formed in metallic casing 20, it is possible to perform communication using slit 23*a* even when slit 21*a* is covered by another conductor, for example. For that reason, with lighting driving device 10, it is possible to secure a communication function and a communication quality of communication circuit 43.

In addition, in lighting driving device 10 according to the present variation, the insulator (guide 110) covers the entirety of slit 21*a*.

In this manner, since the insulators (guide 110 and cover 350) cover the entirety of slit 21*a* and slit 23*a*, it is possible to prevent slit 21*a* and slit 23*a* from being covered by conductor 5 or another conductor even when lighting driving device 10 falls accidentally after lighting driving device 10 is mounted to conductor 5. For that reason, with lighting driving device 10, it is possible to secure a communication function and a communication quality of communication circuit 43.

The present variation also produces other advantageous effects in the same manner as the embodiment.

Variation 3 of the Embodiment

The following describes lighting driving device 10 according to Variation 3 of the embodiment.

In FIG. 9, (a) is a side view which illustrates lighting driving device 10 and guide 410 according to Variation 3 of the embodiment. In FIG. 9, (b) is a rear view which illustrates lighting driving device 10 and guide 410 according to Variation 3 of the embodiment.

The present variation differs from the embodiment in that guide 410 guides conductor 5 on an end side of slit 21*a*.

Lighting driving device 10 of the present variation is similar to or same as lighting driving device 10 of the embodiment in other structural components, and thus the same structural components are assigned with the same reference signs, and detailed descriptions for the structural components will be omitted.

As illustrated in (a) and (b) of FIG. 9, guide 410 is a plate-like component having an elongate shape in the X-axis direction, and covers the entirety of slit 21*a*. In guide 410, guide groove 411 which is recessed in the Z-axis plus direction and guides conductor 5 is formed. Guide groove 411 has a width gradually decreasing in the Z-axis plus direction. Guide groove 411 is formed on an end side of guide 410. According to the present variation, guide groove 411 is formed on the X-axis minus side when lighting driving device 10 and guide 410 are viewed from the Z-axis minus side. It should be noted that guide groove 411 may be formed on the X-axis plus side in guide 410.

In this case, it is possible to mount lighting driving device 10 to conductor 5 according to a position of conductor 5 that depends on an environment in which lighting apparatus 1 is installed. For that reason, the degree of freedom of installing lighting apparatus 1 is less likely be impaired.

The present variation also produces other advantageous effects in the same manner as the embodiment.

Other Embodiments

Although the embodiment and Variations 1 to 3 of the embodiment have been described thus far, the present disclosure is not limited to the above-described embodiment and Variations 1 to 3.

For example, according to the foregoing embodiment, the radio control circuit may perform communication using ZigBee (registered trademark), or may perform communication using Bluetooth (registered trademark), wireless local area network (LAN), etc.

Although one or more aspects have been described based on the embodiment and Variations 1 to 3 of the embodiment thus far, the present disclosure is not limited to the above-described embodiment and Variations 1 to 3 of the embodiment. Other forms in which various modifications apparent to those skilled in the art are applied to the embodiment, or forms structured by combining structural components of different aspects of the embodiment may be included within the scope of the one or plural aspects, unless such changes and modifications depart from the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting driving device to be installed on a part of a structure, the lighting driving device comprising:

a communication circuit which performs wireless communication;

a driving circuit which supplies power to a light emitter;

a metallic casing including walls defining a space to accommodate the communication circuit and the driving circuit, wherein one of the walls has a slit through which radio waves pass and is a closest wall of the walls to the part of the structure; and an insulator which is disposed on the one of the walls that has the slit and between the one of the walls and the part of the structure, and spaces apart the slit from the part of the structure.

2. The lighting driving device according to claim 1, wherein the part of the structure is a conductor, the insulator is a guide for mounting the metallic casing to the conductor, and the guide mounts the metallic casing to the conductor such that the conductor and the slit are three-dimensionally crossed with each other.

3. The lighting driving device according to claim 2, wherein the conductor has an elongate shape, and the guide mounts the metallic casing to the conductor such that the conductor and the slit are substantially orthogonal to each other in a plan view of the conductor and the slit.

4. The lighting driving device according to claim 2, wherein the guide has a lateral wall portion which restricts a movement of the metallic casing.

5. The lighting driving device according to claim 4, wherein the lateral wall portion of the guide comprises a pair of lateral wall portions, and the pair of lateral wall portions hold the conductor therebetween when mounting the lighting driving device to the conductor.

6. The lighting driving device according to claim 4, wherein the lateral wall portion of the guide comprises a pair of lateral wall portions, and a distance between the pair of lateral wall portions increases in a direction in which the pair of lateral wall portions rise from a bottom member.

7. The lighting driving device according to claim 2, wherein a distance between the conductor and the slit is less than or equal to 20 mm.

8. The lighting driving device according to claim 1, wherein the metallic casing includes a plurality of slits in addition to the slit, and the metallic casing has one or more portions each of which includes at least one of the plurality of slits and on each of which the insulator is mounted.

9. The lighting driving device according to claim 1, wherein the insulator covers an entirety of the slit.

10. The lighting driving device according to claim 1, wherein the insulator is detachable from the metallic casing.

11. The lighting driving device according to claim 2, wherein when the metallic casing is mounted to the conductor with the guide being interposed therebetween, the guide covers a portion of the slit.

12. The lighting driving device according to claim 1, wherein the slit has a length that is at least a half of a wavelength of a radio signal passing through the slit when the communication circuit performs wireless communication.

13. The lighting driving device according to claim 1, wherein the communication circuit is disposed in proximity to the slit.

14. A lighting apparatus, comprising:

a light emitter; and the lighting driving device according to claim 1 which supplies power to the light emitter.

15. A lighting driving device to be installed on a part of a structure, the lighting driving device comprising:

a communication circuit which performs wireless communication with an external device that transmits a radio signal for controlling a light emitter;

a driving circuit which supplies power to the light emitter according to a control signal received by the communication circuit;

a metallic casing including walls defining a space to accommodate the communication circuit and the driving circuit, wherein one of the walls has a slit through which radio waves pass and is a closest wall of the walls to the part of the structure; and an insulator which is disposed on the one of the walls that has the slit and between the one of the walls and the part of the structure, and spaces apart the slit from the part of the structure.

* * * * *